US008702471B2

(12) United States Patent
Lyman

(10) Patent No.: US 8,702,471 B2
(45) Date of Patent: Apr. 22, 2014

(54) WEARABLE, COMBINED GARMENT AND MASTECTOMY PROSTHESIS

(76) Inventor: Linda C. Lyman, Salt Lake City, UT (US)

( * ) Notice: Subject to any disclaimer, the term of this patent is extended or adjusted under 35 U.S.C. 154(b) by 354 days.

(21) Appl. No.: 13/186,836

(22) Filed: Jul. 20, 2011

(65) Prior Publication Data

US 2012/0021668 A1 Jan. 26, 2012

Related U.S. Application Data

(60) Provisional application No. 61/366,478, filed on Jul. 21, 2010.

(51) Int. Cl.
*A41C 3/00* (2006.01)
*A41B 3/00* (2006.01)

(52) U.S. Cl.
USPC ..... 450/54; 450/57

(58) Field of Classification Search
USPC ..... 450/36, 39, 54–57; 2/267, 268
See application file for complete search history.

(56) References Cited

U.S. PATENT DOCUMENTS 1,878,755 A * 9/1932 Caldor ..... 450/85
2,156,478 A * 5/1939 Kemp ..... 450/85
2,521,373 A * 9/1950 Hutchison ..... 450/77
2,638,595 A * 5/1953 Goebel ..... 450/85
4,261,366 A * 4/1981 Lamborn ..... 450/54
4,300,568 A * 11/1981 Blanckmeister ..... 450/85
4,699,144 A * 10/1987 Sherwood ..... 450/54
5,951,364 A * 9/1999 Brown et al. ..... 450/1
6,390,885 B1 * 5/2002 Brooks ..... 450/1

* cited by examiner

*Primary Examiner* — Gloria Hale
(74) *Attorney, Agent, or Firm* — Jacques M. Dulin, Esq.; Innovation Law Group, Ltd.

(57) ABSTRACT

Post-operative medical prosthetic devices, more particularly a combined garment and prosthesis that is useful for female patients having major chest trauma, including post-op mastectomy, burn, heart and lung surgery, and for patients having severe chest skin sensitivity, including skin and sub-dermal post-op surgical exposed tissue, healing scars, gangrenosis, chemotherapy and the like. The inventive garment/prosthesis includes an undergarment comprising a uniquely designed upper-half-bra having a special pocket for an insertable/removable upper-half-breast prosthesis that only contacts the upper portion of the chest, well above areas of surgical trauma. This provides a cantilever, permitting over-garments to drape free from contact with the chest and stomach exterior surfaces. In a second embodiment, the inventive garment/prosthesis is integrated with an over-garment, including by way of example: fashionable dresses, blouses, camisoles, tailored shirts, gowns, loungewear, sleepwear, sportswear, caftans, formal attire, career wear, and the like.

12 Claims, 12 Drawing Sheets

FIG. 4A
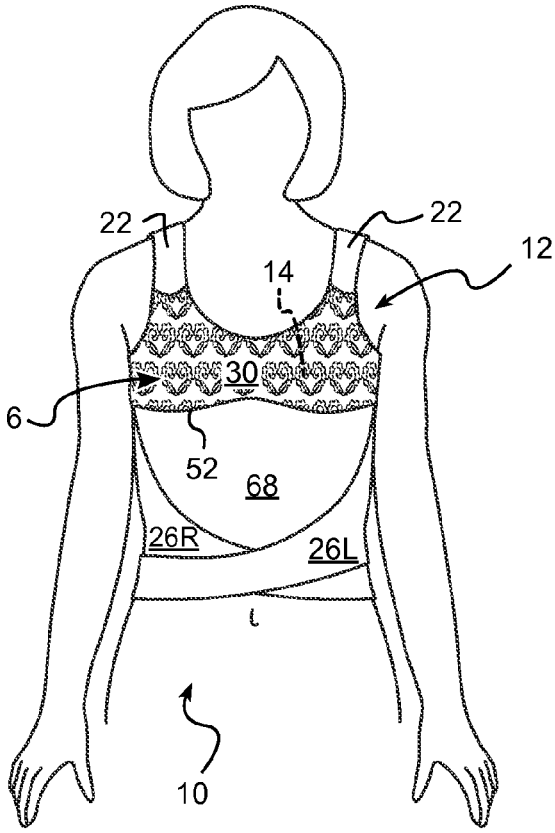
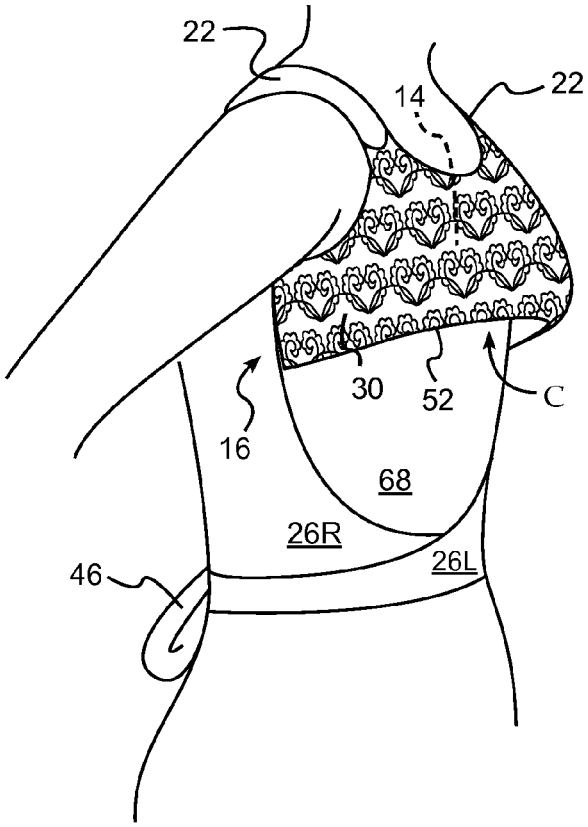
FIG. 4B

FIG. 6A
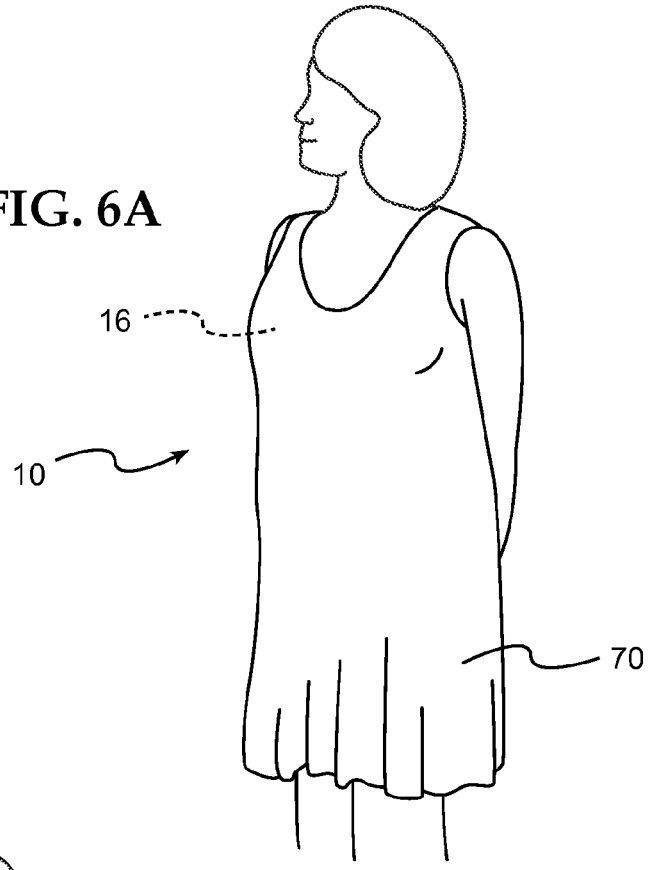
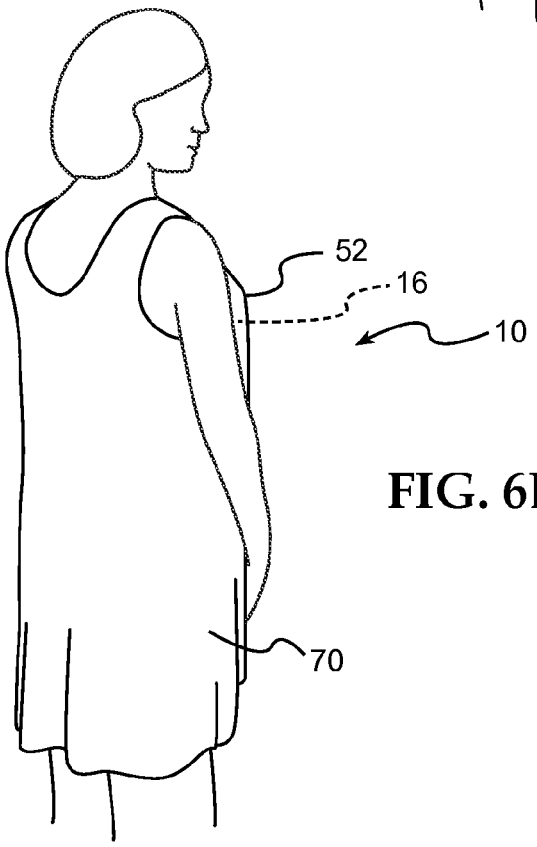
FIG. 6B

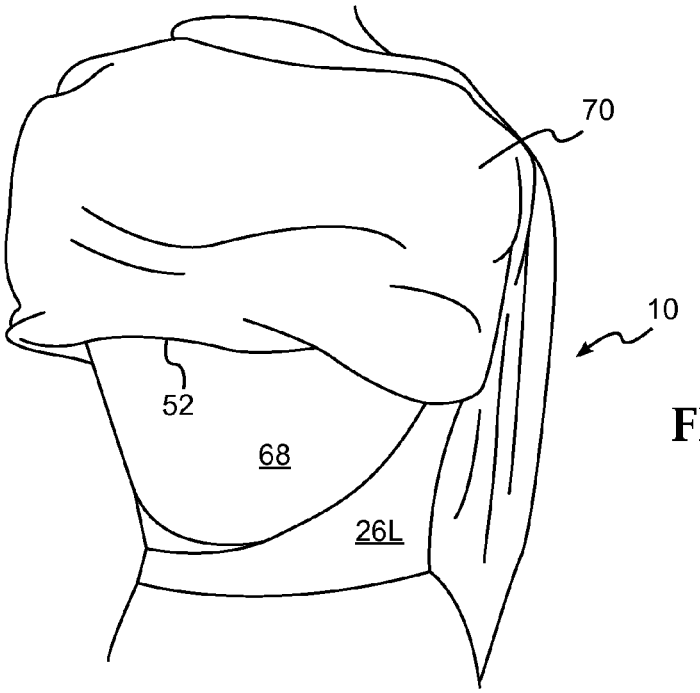
FIG. 6C
FIG. 6D
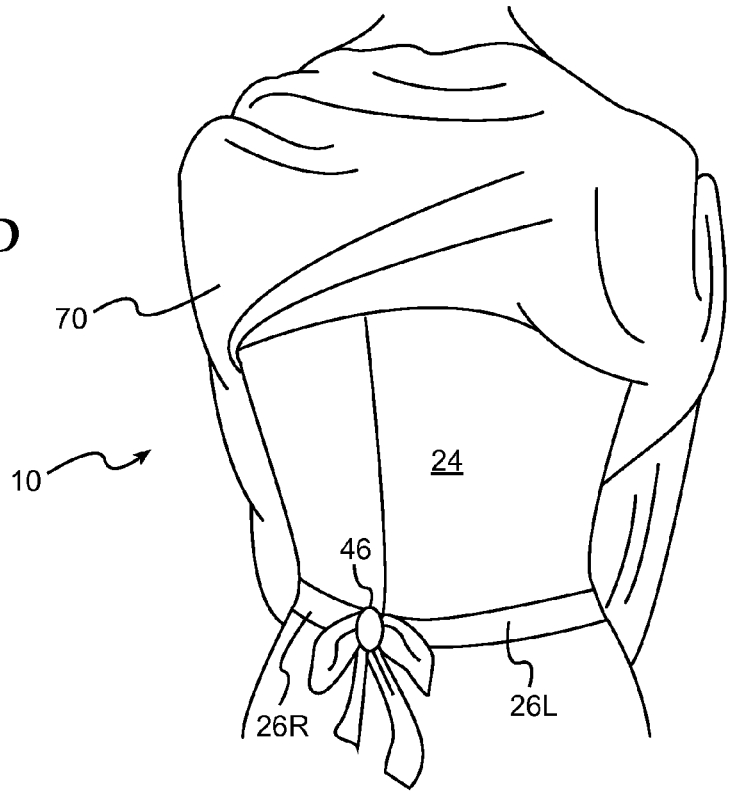

WEARABLE, COMBINED GARMENT AND MASTECTOMY PROSTHESIS

CROSS-REFERENCE TO RELATED APPLICATION

This is the Regular US Patent Application corresponding to, and claiming priority of, U.S. Provisional Application Ser. No. 61/366,478 entitled Wearable, Combined Garment and Mastectomy Prosthesis, filed by the same inventor on Jul. 21, 2010, the priority of which is hereby claimed under 35 USC§§119, 120 ff.

FIELD

The invention relates to post-operative medical prosthetic devices, and more particularly to a combined garment and prosthesis that is useful for female (and optionally male) patients having chest or abdominal trauma, including post-op mastectomy, burn, heart and lung surgery, and for patients having severe chest skin sensitivity, including skin and sub-dermal post-op surgical exposed tissue, healing scars, and chemo-therapy to name a few. The inventive garment/prosthesis comprises a partial wrap-around undergarment comprising a specially designed partial bra having a special pocket for at least one upper-half-breast prosthesis that permits over garments to drape free from contact with the chest walls. In a second embodiment, the inventive garment/prosthesis is integral with an over-garment, including by way of example: fashionable dresses, blouses, camisoles, tailored shirts, gowns, loungewear, nightwear, sportswear, caftans, chausables, and the like.

BACKGROUND

Major trauma and surgery to the thoracic region, including both chest and stomach, typically results in patients experiencing extreme sensitivity during healing phase to the skin or sub-dermal tissue that is exposed. This sensitivity often becomes a permanent neuralgic condition, in which the patient cannot tolerate substantial contact of clothing on the skin. Likewise, post-op lymphedema results in sensitivity and requires draining.

In the case of mastectomy patients, full breast prostheses are offered, either single breasts, Left or Right, in the case of a single breast excision, or dual prostheses. However, such prostheses require a harness to hold them tight to the chest. Typically, these prostheses take the form of a conventional bra with a full breast form that is integral to the bra or may be separately inserted in a pocket. These prostheses may be constructed of foam, and covered with a latex, silicone or other elastomeric covering that is colored to mimic skin tone and texture, and the weight of a natural breast. Some breast forms include a chest-side surface that is patterned with ridges to provide air circulation and to massage the chest wall.

However, patients who experience contact sensitivity and neuralgic conditions cannot wear such prostheses, and indeed many cannot tolerate even the weight of draped garments moving across the chest. For such patients, having to wear no prostheses, and thus loosing their figure, is psychically traumatic, and can lead to significant emotional scarring.

Accordingly, there is a significant and unmet need in the art to provide a combined garment and prosthesis that is wearable, that does not put pressure on the chest or abdominal wall, and can serve as an undergarment like a bra, as well as a part of a fashionable over-garment.

THE INVENTION

Summary, Including Objects and Advantages

The invention is directed to post-operative medical prosthetic devices, and more particularly to a combined garment and partial female breast prosthesis that is useful for patients, predominantly female but optionally also male, who have had surgery or treatment for chest and abdominal trauma, broadly including, but not limited to, women (and men) having undergone chest and/or abdominal surgery, or treatment for ventral traumatic or epidermal conditions or injuries, such as: post-op mastectomy; burn, heart and lung surgery; and for patients having severe chest and/or abdominal skin sensitivity, including skin and sub-dermal post-op surgical exposed tissue, healing scars, gangreneosis, and chemotherapy, to name a few.

In a first embodiment, the inventive garment/prosthesis comprises a partial wrap-around undergarment including a uniquely designed partial bra having a special pocket for at least one prosthesis of the upper half of a female breast that permits over-garments to drape free from contact with the chest walls. In a second embodiment, the inventive garment/half-breast prosthesis is integrated into a fashionable over-garment, including by way of example: dresses, blouses, camisoles, tailored shirts, gowns, loungewear, sleepwear, sportswear, caftans, formal attire, career-wear, and the like, which may be designer quality.

In one exemplary embodiment, the partial bra includes a camisole-style (scooped) back that extends diagonally laterally into elongated tails that wrap fully around the waist, beginning at the back of the patient, thence around to the patient's front side where they diagonally overlappingly cross, and thence on around to the patient's back where they are tied. The diagonal orientation of the side tails permits the entire chest wall and stomach to be exposed and free of any fabric contact with the skin, scar tissue, or other sensitive dermal areas by virtue of the front-to-back wrap of the securing lateral side tails. The partial bra may be made of a wide variety of materials, in any selected size to fit individual patients, in any desired color to coordinate with the patient's preference or to coordinate with garments worn over, and the exterior front surface of the partial bra may be faced with decorative material and/or fabric.

By partial bra is meant a bra having a breast portion that is less than a full breast dimension or coverage. In a typical implementation of the inventive garment/prosthesis, the bra is essentially the upper half of a bra, and includes an outer and inner layer of fabric sewn together at the upper and lower margins, providing a transverse pocket with access apertures on the side vertical margins. The female upper-half breast prosthesis is inserted into the upper-half bra garment pocket with its top sloping surface oriented upward. The prosthesis is contoured in a natural "slope" form of the upper half of a female breast, but being undercut to have no lower pendant breast portion, the bottom surface of the prosthesis forming the underside of a "shelf", the outer lower edge of which generally follows a horizontal line approximately at the level of the nipples of a natural breast. Upon insertion of the half-breast prosthesis into the undergarment pocket, an over-garment will drape along said prosthesis upper half sloping contour and over said shelf, thereby providing a clearance space between the over-garment and exposed sensitive chest and ventral areas to prevent chafing and irritation.

It should be understood that for partial or single mastectomies, the prosthesis may be provided as having at least one half-breast prosthesis, that is, a left or right half-breast. The bra pocket is accordingly half-sized, left or right, with the remainder of the bra being a standard cup bra configuration.

The inventive garment/prosthesis may be a separate element, or combined with an over-garment. In an exemplary combination implementation, a dress, chemise or shirt over-garment is sewn along its upper margin to the upper margin of the half-bra in the front, and optionally along the inner margin of the bra portion straps, and hangs free both front and back, with the upper half-bra structure cantilevering the over-garment fabric outwardly and away from the chest and stomach skin, thereby providing the spacing for protection against irritation.

In an important alternate embodiment, one or both of the side tails may include a vertically oriented, top opening pocket for inclusion of a drainage bag of the type supplied by the medical services provider for patients in which either the surgical site needs drainage, or for managing lymphedema drainage.

The half-breast prosthesis is cleanable, typically by washing with an anti-bacterial soap, such as a liquid hand or face soap, or a gentle soap like "Woolite" brand soap. Note that the patient need not buy more than one prosthesis, as the bra portion of the under garment includes the hidden pocket, or pockets, so that the prosthesis may be removed from one style or color of under garment and inserted in a different style or color garment.

In still additional embodiment implementations of the inventive half-breast prosthesis plus garment, a prosthesis pocket may be eliminated with the half-breast prosthesis being secured to the bra fabric by hook and loop fasteners, with one of hook or loop portions secured to the prosthesis back face (the surface facing the outer surface of the bra fabric) and the bra fabric outer surface including aligned loop or hook portions to receive the prosthesis. In other alternatives, the prosthesis may be secured to the bra fabric by snaps, or small plastic or metal hook/eye assemblies such as the hooks and eyes ordinarily used to fasten bra straps together.

In addition, it is important that the prosthesis is flexible and configured with a natural breast top surface slope while not being rigid, and having sufficient compliance (yieldability) to present a natural appearance while not so compressible to be unable to maintain the cantilever required to produce a non-chafing clearance gap. Thus, the prosthesis may be any suitable material, such as batting-filled fabric, semi-rigid foam, a soft foam covered form, such as a high-density open-cell visco-elastic memory foam (density in the range of from about 2 to about 6 lbs/cu. ft.), or plastic-encapsulated silicone gel such as is used for breast implants. The material of the upper-half-breast prosthesis must have enough body that the weight of the garment is adequately supported to provide the gap, that is the garment does not compress the prosthesis such that the gap between the draped fabric and the sensitive chest or/and abdomen skin or scar surface is eliminated, leading to chafing.

An important advantage of the inventive garment/prosthesis includes providing protection for the sensitive post-operative skin areas against bumping in public or from chafing, for example, by garments or an automotive seat belt.

One skilled in the garment design field will readily appreciate that it is straight-forward to design-in or design-for the inventive partial bra garment/prosthesis a wide range of utilitarian and fashionable garments. The inventive partial bra garment/prosthesis thus permits patients to reclaim their emotional sense of self while remaining highly fashionable and functionally able to participate in a full range of public events. In addition, while the presently preferred embodiment calls for side lateral tails for the front-to-back waist-line ties, it should be understood that a the upper-half bra garment may be secured in the back by standard mid-back straps with single or multiple hook fasteners, or by wrap-style ties extending downwardly and diagonally from the bra back panels.

BRIEF DESCRIPTION OF THE DRAWINGS

The invention is described in detail by reference to the figures, which include both patterns and line drawings of an actual, full sized prototype of the inventive garment/prosthesis in which:

FIG. 1 is a pattern set, showing plan-view type patterns of the various elements in FIGS. 1A through 1H in which

FIGS. 4A-4C are a series of line drawings of the inventive garment/prosthesis of FIGS. 1-3 showing the in-use position of the upper-half-bra system as an under-garment;

FIGS. 6A-6D are a series of line drawings of the combination of the inventive garment/prosthesis of FIGS. 4A-4C (in red fabric) with a red dress having a scoop neck-line, front and back, and showing how the chest and stomach remain free from fabric contact.

DETAILED DESCRIPTION OF THE INVENTION, INCLUDING THE BEST MODE

The following detailed description illustrates the invention by way of example, not by way of limitation of the scope, equivalents or principles of the invention. This description will clearly enable one skilled in the art to make and use the invention, and describes several embodiments, adaptations, variations, alternatives and uses of the invention, including what is presently believed to be the best modes of carrying out the invention.

In this regard, the invention is illustrated in the several figures, and is of sufficient complexity that the many parts, interrelationships, and sub-combinations thereof simply cannot be fully illustrated in a single patent-type drawing. For clarity and conciseness, several of the drawings show in schematic, or omit, parts that are not essential in that drawing to a description of a particular feature, aspect or principle of the invention being disclosed. Thus, the best mode embodiment of one feature may be shown in one drawing, and the best mode of another feature will be called out in another drawing.

The Figures, both pattern line drawings and photographs, are numbered and annotated so that one skilled in the arts of garment design, fashion design and garment construction, by reference to the attached parts list, will easily be able to understand the materials, method of construction and how to use the inventive garment/prosthesis, and will be able to easily assemble the parts to achieve the functionality shown and described herein.

Figure 1A:
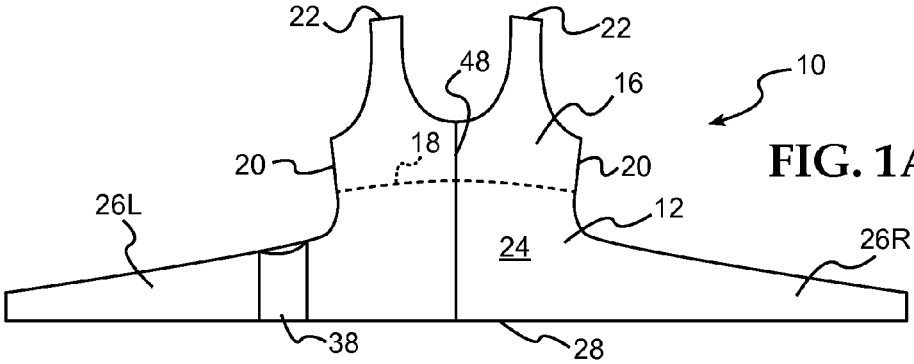
FIG. 1A shows the pattern for the garment portion from the back, untied.
Figure 1B:
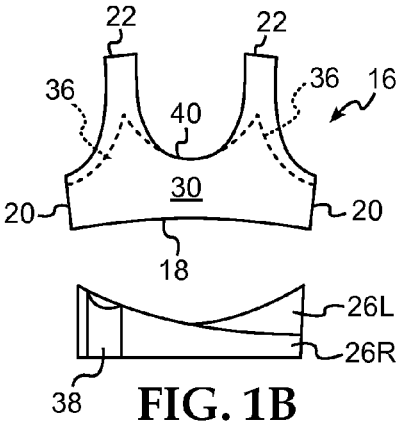
FIGS. 1B abd 1C show the garment's half-bra portion from the front with 1B showing from the outside and 1C showing from the inside.
Figure 1C:
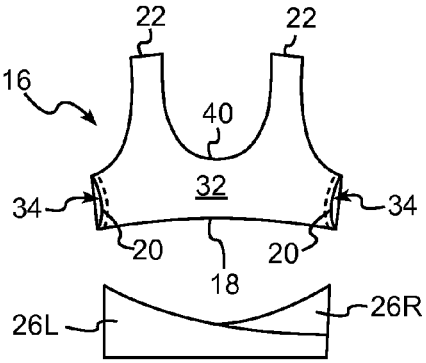

Exemplary patterns of the several elements of the inventive garment/prosthesis 10 are shown in FIGS. 1A through 1H which illustrate in FIG. 1A an upper-half-bra garment 12 from the back, untied, into which an upper-half-breast prosthesis 14 (FIG. 1E) may be removably inserted. The bra portion 16 of the garment 12, best seen in FIGS. 1B and 1C, exterior and interior (skin facing) views respectively, is conveniently made of a double layer of fabric, folded or stitched together along the bottom margin 18. At least one of the layers extends upwardly in the form of spaced shoulder straps 22, which continue over the wearer's shoulders to the back and thence downwardly to form a back panel 24 having elongated lateral tie strips 26L (left), 26R (right) and a common waist margin 28. The double layer of fabric of the bra portion 16 comprises an exterior panel 30 and an interior panel 32, seen in FIGS. 1B and 1C, respectively. The side margins 20 of the two panels 30, 32 are not stitched together. Rather the interior panel 32, FIG. 1C, is stitched to the back panel 24, FIG. 1A, along common margin 20. The result is a pocket formed between the panels 30 and 32, having side openings 34 into which the prosthesis 14 may be inserted, the as-inserted outline being shown in FIG. 1B as the dashed line 36. An optional pocket 38 may be provided in one or both tie strips 26L or 26R to receive a drainage bag.

Figure 2A:
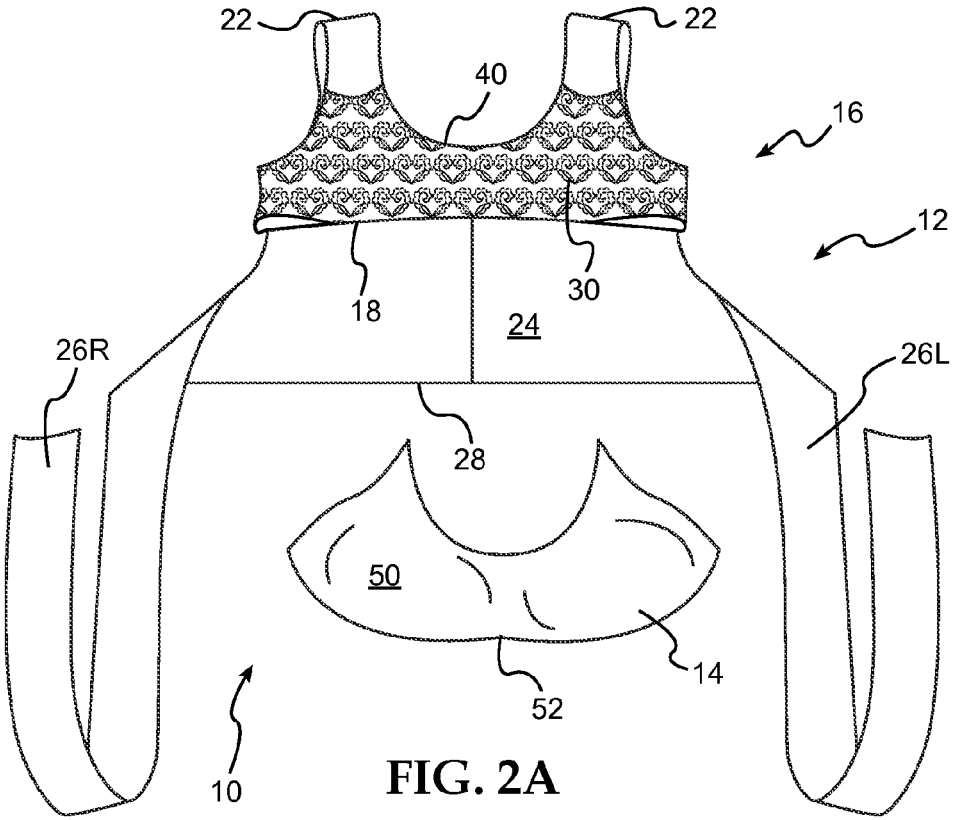
FIGS. 2A-2H are a series of line drawings showing a first embodiment of the inventive garment/prosthesis as produced from the patterns shown in FIG. 1A-1F, detailing the upper-half-bra garment and the upper-half-breast prosthesis, including inserting the prosthesis in the bra pocket from the side.

One skilled in the art will recognize that the bra-portion of the garment 16 may be configured in a wide range of designs. As shown, the straps 22 are relatively wide and formed from a continuation of the interior and exterior panels 30, 32, and configured in a scoop neckline 40. The exterior panel may be made of decorative fabric, such as shown in FIGS. 2A and 4A. It should also be understood that while the back panel 24 includes side tie portions 26L and 26R, the bra-portion of the garment may be terminated in the back along line 18, see FIG. 1A, and back bra straps 42L, 42R may be employed, with a closure fastener 44, see FIG. 1G. In this embodiment, the back straps may be a continuation of, or sewn to the side margins 20 of the interior panel 32. It should also be understood that the front, pocket portion of the bra-portion of the garment, shown in FIG. 1B, to the back panel 24 by sewing the exterior panel 30 to the back panel at the side margins 20, so that the pocket entrance 34 is on the interior of the garment, not the exterior as described above. One skilled in this art will readily figure out the simplest, fastest, most secure way to attach the several panels to each other to achieve the described functionality.

Figure 1D:
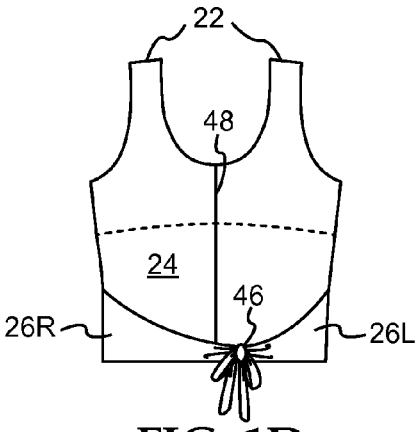
FIG. 1D showing the garment portion from the back in the tied configuration.

The garment portion 16 is pulled over the shoulders, either before or after the prosthesis 14 is inserted in the pocket 34, the ties 26L and 26R are pulled around to the front, criss-crossed, taken to the back and tied in a bow 46, as shown in FIG. 1D. Also shown is seam 48, which illustrates that optionally, the back panel 24 may be formed of two parts.

Figure 1E:
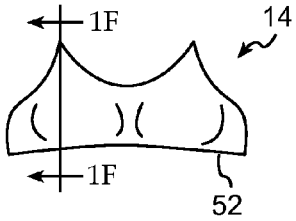
FIG. 1E showing the upper-half-breast prosthesis from the front and FIG. 1F showing the upper-half-breast prosthesis in section through the line 1F-1F of FIG. 1E.
Figure 1F:
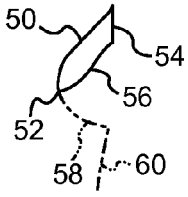
Figure 1G:
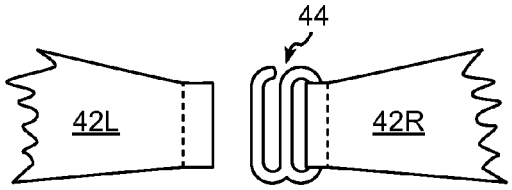
FIG. 1G showing an alternate securing back clasp for the garment's half-bra portion.

FIGS. 1E and 1F show in front elevation and side section view, respectively, the upper-half-breast prosthesis of the invention. Note in FIG. 1F the prosthesis has an upper, outer surface 50 that follows the natural contour of a normal breast, and that it terminates at a lower edge 52 along a line defined between the normal placement of nipples. The back face of the prosthesis 14 includes a generally vertical portion 54 that rests on the upper face of the patient's chest, well above the line of surgery (in the case of mastectomies), and a diagonal portion 56, shown in this embodiment as somewhat curved to provide sufficient structural support for the weight of an over-garment. The lower, pendulous curve of a normal breast is shown as dashed line 58, and of the outer face of the abdomen as 60. Thus, the inventive prosthesis can be readily recognized as only an upper-half-breast form device, that has only a small strip 54 that causes pressure on the upper area of the chest, well above surgical involvement. The natural outer curve 50 provides a natural-looking drape form for an over-garment, and the horizontal, lateral projection away from the plane of the chest and stomach provides a shelf, from the outer edge of which, 52, the over-garment hangs down, away from the chest wall and stomach. This is best seen in FIGS. 4-6.

Figure 1H:
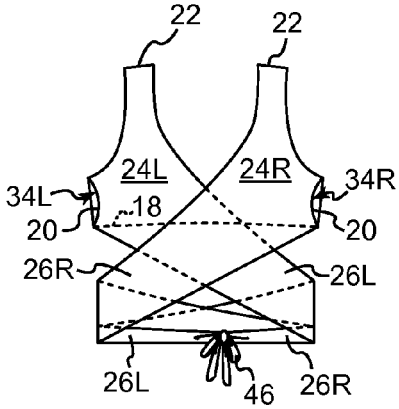
FIG. 1H showing from the back, a wrap-style construction for the under-garment.

FIG. 1H shows another embodiment of the under-garment, in this illustration a wrap style, shown from the back. The front view of this embodiment is the same as FIG. 1B. The lower edge 18 of the bra portion 16 defines the bottom of the left and right pockets, 34L and 34R which receive the upper-half-breast prosthesis 14 (not shown). Note that two separate upper-half-breast prosthesis forms may be used, one for the left and one for the right, and in the case of a single mastectomy, only one is used in place of the excised breast. The ties 26L and 26R extend downwardly and diagonally from the two back panels 24L and 24R of the bra portion. They are criss-crossed in the back as shown, wrapped around the waist, and tied in bow 46 in the back as shown. Conversely, where there is little or no chest or stomach skin sensitivity, the view in FIG. 1H may be taken as a front view, with the ties criss-crossed in the front over the stomach, criss-crossed again in the back, brought around and tied in the front.

Figure 2B:
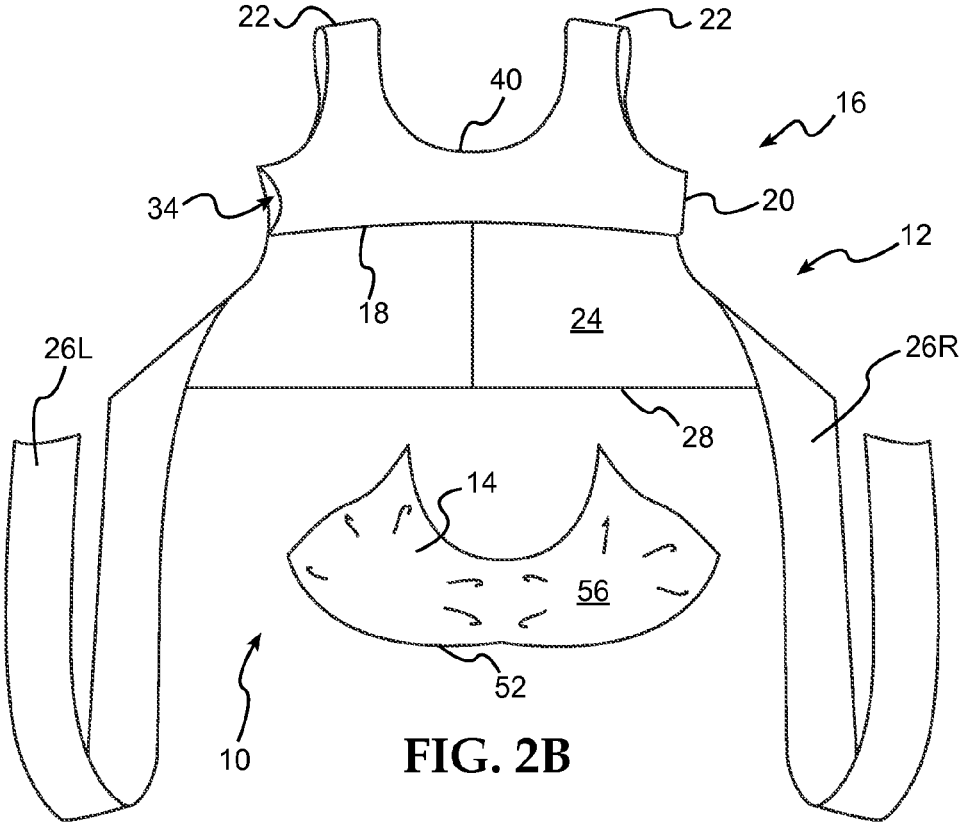
Figure 2C:
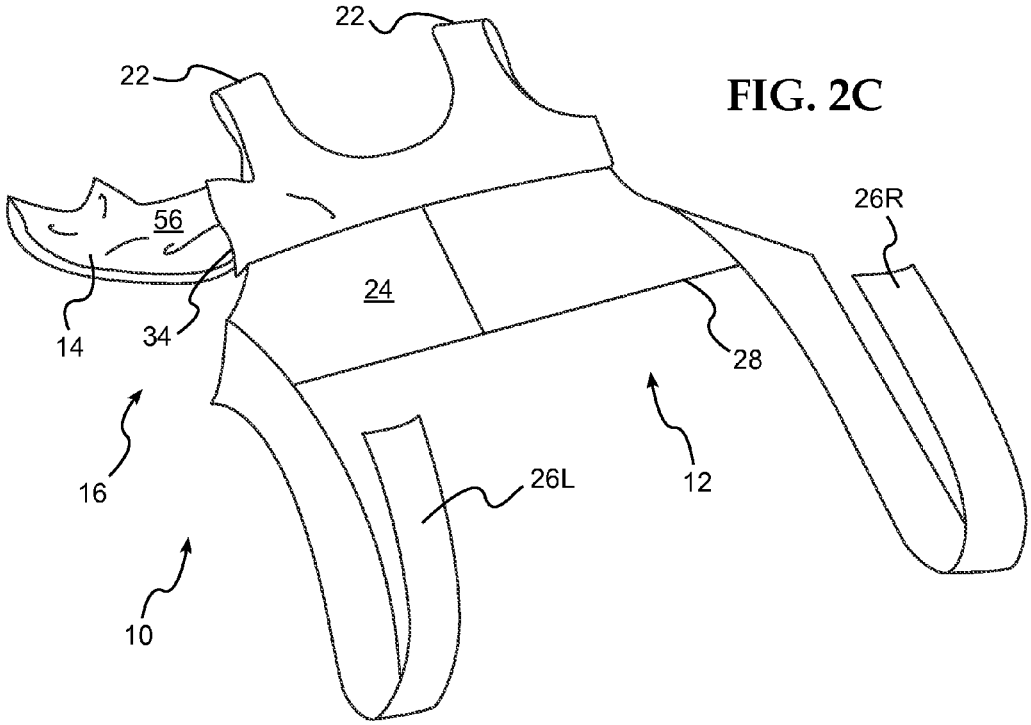
Figure 2D:
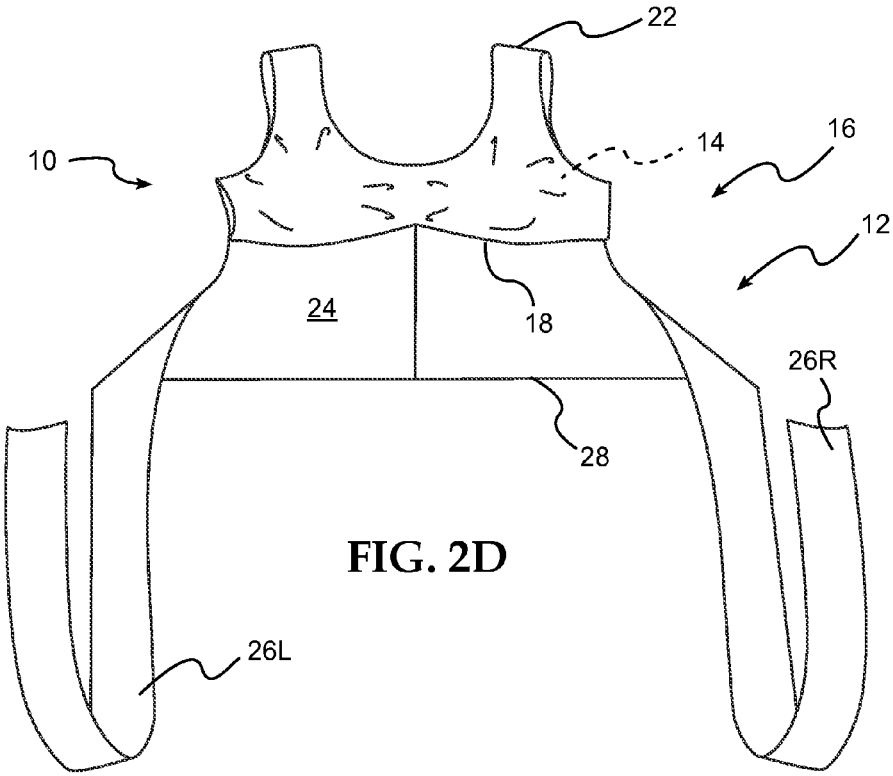
Figure 2E:
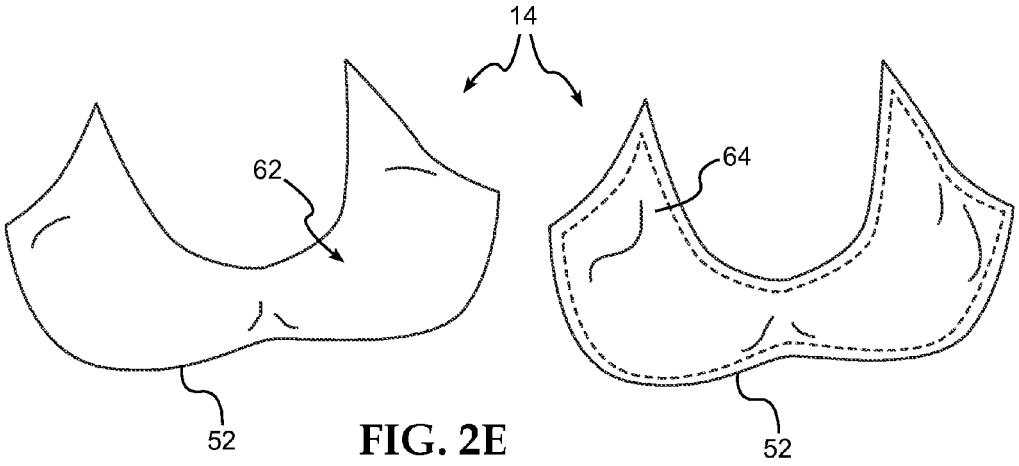
Figure 2F:
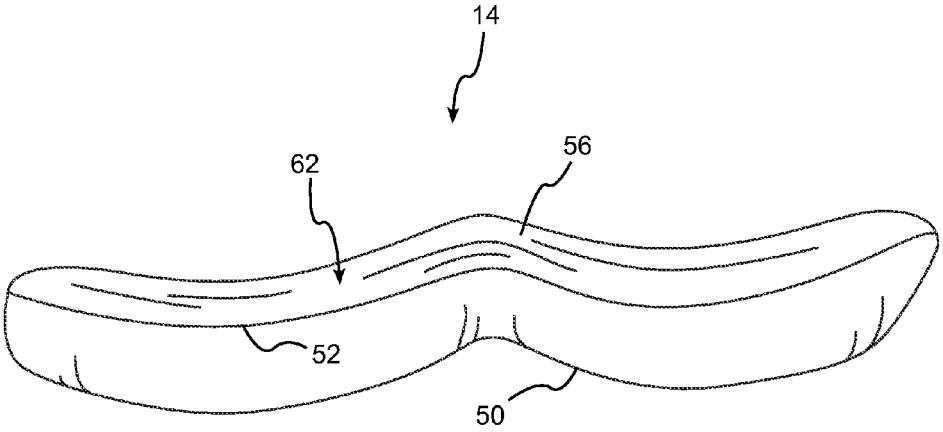
Figure 2G:
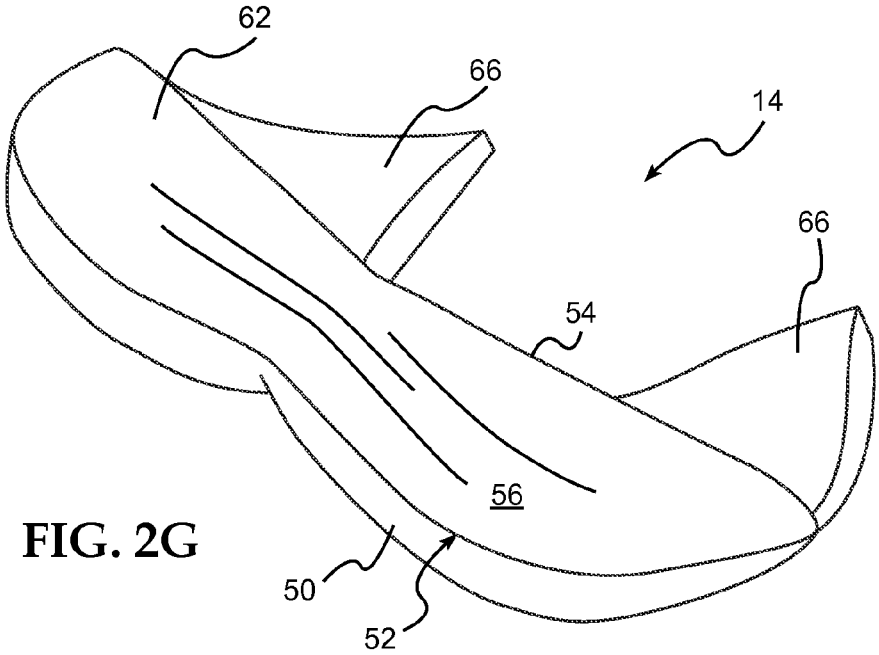
Figure 2H:
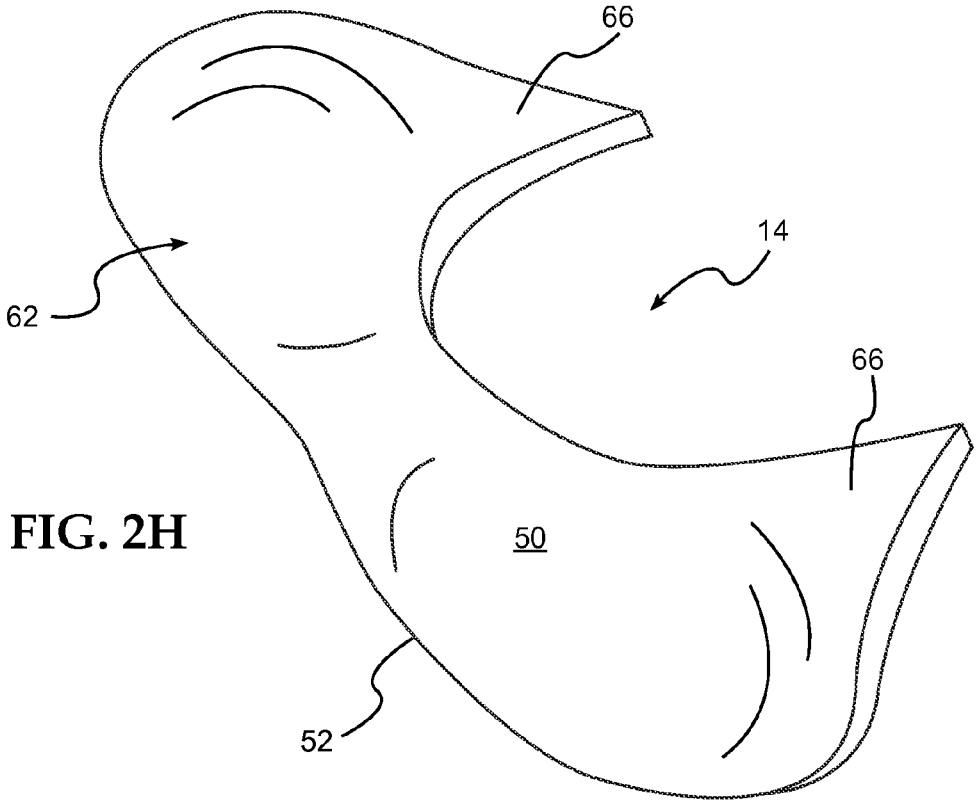

FIGS. 2A-2H are a series of photos showing the first embodiment of the inventive garment/prosthesis 10 as produced from the patterns shown in FIG. 1A-1F, detailing the upper-half-bra garment 12 and the upper-half-breast prosthesis 14, including inserting the prosthesis 14 in the bra pocket 34 from the side. FIG. 2A shows the inventive garment portion 12 from the front, noting the decorative lace facing on the panel 30. The prosthesis is shown before insertion from the front facing side; note that the foam of the prosthesis is enveloped in a fabric cover. FIG. 2B shows the inventive garment portion 12 from the inner face, again without the prosthesis 14 inserted. Compare the contour of the exterior face 50 with the interior face 56, and the fact that the bottom margin may be curved to follow the natural bilateral breast bottom curve. FIGS. 2C and 2D are a progression showing inserting the covered prosthesis 14 into the pocket through the opening 34, with the prosthesis fully inserted in proper position in FIG. 2D. FIGS. 2E-2H are a set of close-ups of the prosthesis, in this example a bilateral prosthesis 14, in which FIG. 2E shows on the left the foam prosthesis, and on the right the prosthesis covered by a hypoallergenic fabric casing, such as silk, polyester, fine cotton or the like. FIG. 2F shows the prosthesis in profile, from the bottom, the contour of the breasts being evident in the surface 50, and the bottom marginal edge, or drape edge 52 also being a bi-convex curve. The inner face 56 is spaced away from the surgically affected chest wall when positioned in the pocket of the upper-half-bra garment portion 16. FIGS. 2G and 2F are isometric views, inner side up and outer side up, respectively of the foam prosthesis, showing the upper-half-breast configuration. In this embodiment, a pair of generally triangular wings 66, tapering upwardly to a point, are provided as extensions of the outer surface 50 to better mimic the natural skin tension created by normal breast mass.

Figure 3A:
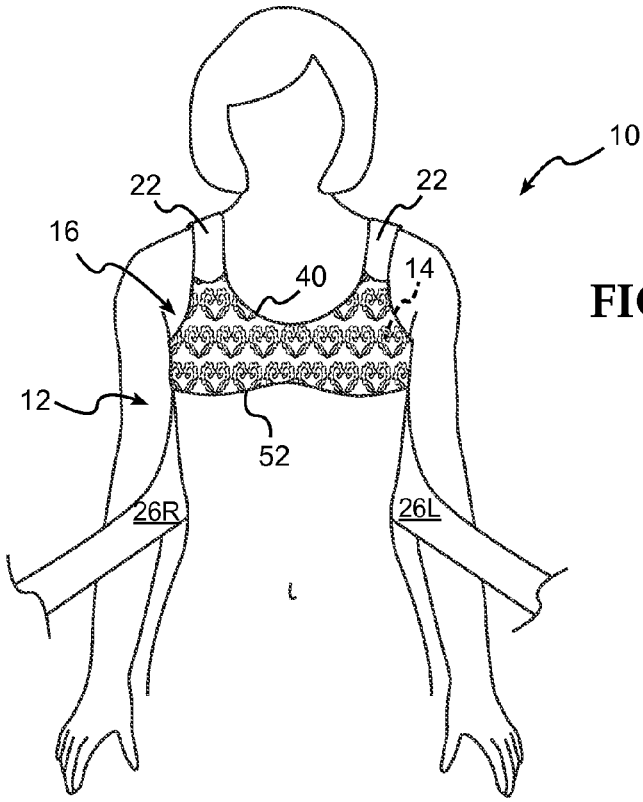
FIGS. 3A-3D are a series of line drawings of the inventive garment/prosthesis of FIGS. 1-2 demonstrating the process of front-to-back tying, using the long lateral side ties, the demonstration being on a dress-makers form.
Figure 3B:
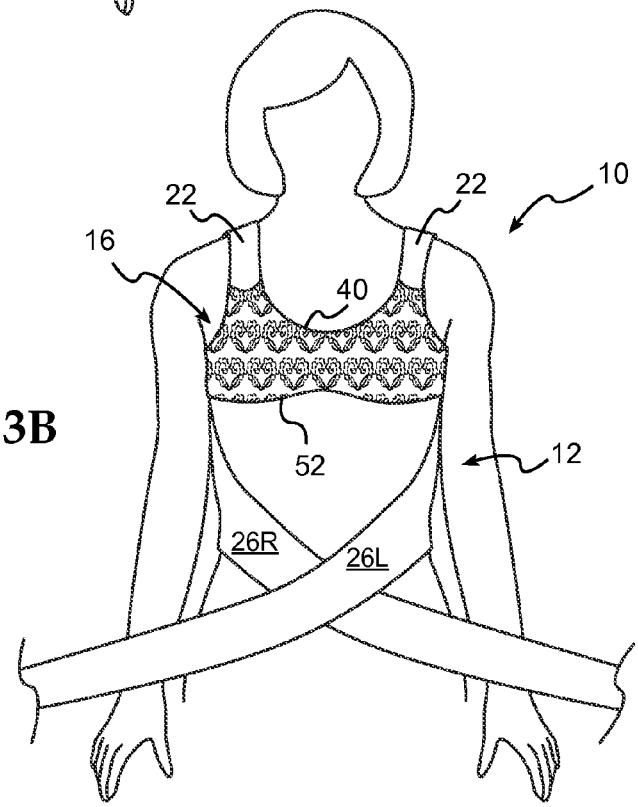
Figure 3C:
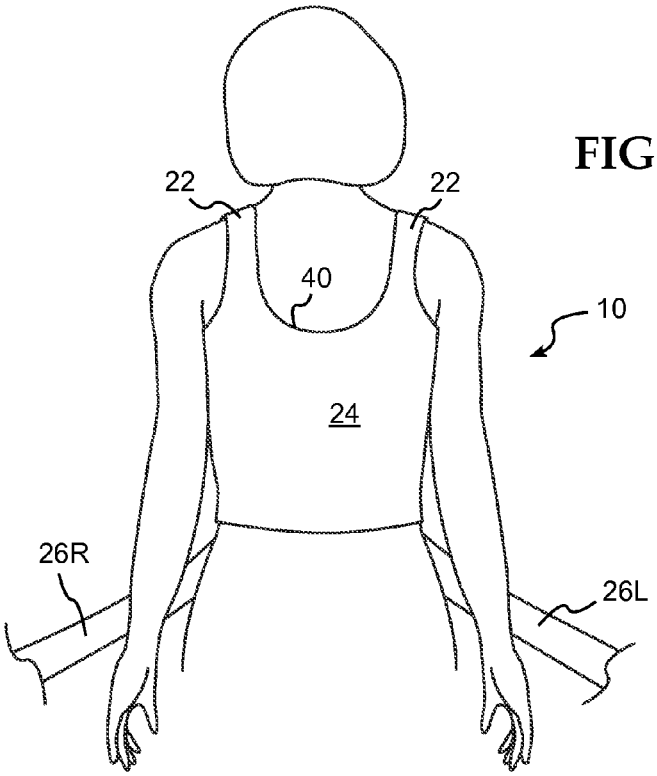
Figure 3D:
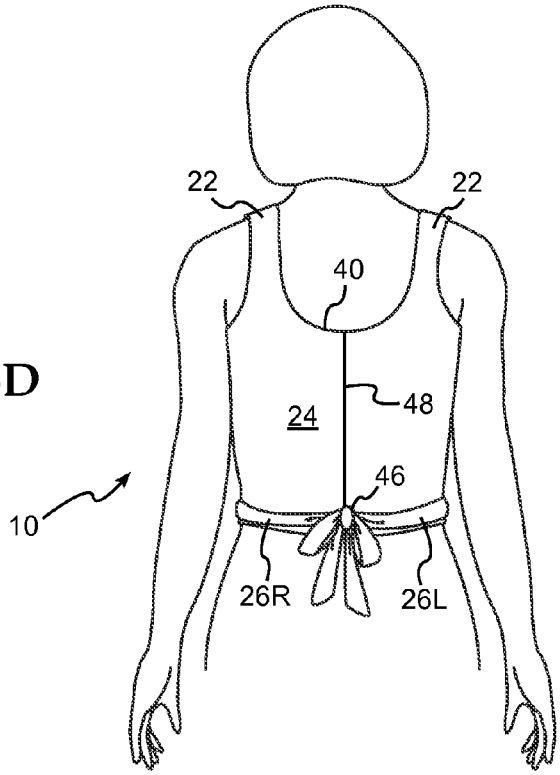

FIGS. 3A-3D are a series of line drawings of the inventive garment/prosthesis 10 demonstrating the process of front-to-back tying, using the long lateral side ties 26L and 26 R, the demonstration being on a dress-makers form. In FIG. 3A the inventive combination garment/prosthesis 10 has been put on, with the shoulder straps 22 on the shoulders on each side of the neck. Note the bottom marginal edge 52 of the upper-half-bra portion 16 of the garment 12 is at approximately the normal level of the nipples, and the prosthesis insert 14 projects off the upper portion of the chest in a natural manner. The lateral ties 26R and 26L are shown extended to the sides to demonstrate that they are extensions of the lower side margins of the back panel (24, not shown in this view). In FIG. 3B the two ties have been crossed at the front at the waistline. In FIG. 3C, a back view, the ties 26R and 26L are extended to the sides, ready to be drawn around the waist, and tied in the back with bow 46, as best seen in FIG. 3D. Note that that the back panel 24 optionally may be made in multiple parts, for example two parts, as shown by the vertical seam 48 securing together the two back panels, together comprising the back 24.

Figure 4C:
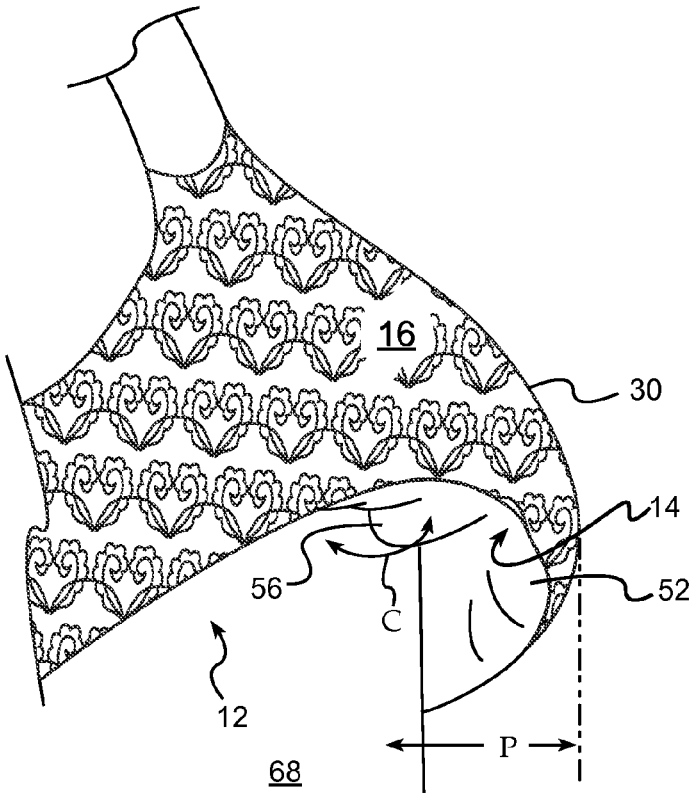

FIGS. 4A-4C are a series of line drawings of the inventive garment/prosthesis 10 showing the in-use position of the upper-half-bra system 12 as an under-garment. FIG. 4A is a front elevation showing the inventive garment/prosthesis in the wearable position, ready for an over-garment, such as a dress to be pulled over the under-garment. Note the open chest and stomach area extending from beneath the prosthesis cantilever, down to the ties 26R/26L. FIG. 4B is an isometric view showing the Cantilever Angle, C, and the garment free area 68. FIG. 4C perhaps best shows the Cantilever Angle, C, formed between the inner face 56 of the prosthesis 14 in the upper-half-bra portion 16 of the garment 12, and the exposed chest wall. Note the chest wall is completely free of fabric contact from the bottom margin 52 upward to the back face 54 (best seen in FIG. 1F). The "shelf" nature of the combination prosthesis as inserted in the pocket of the upper-half-bra garment portion is demonstrated by the Projection Distance, P, which can be varied by sizing and shape of the insertable prosthesis 14, to suit the patient's body form and personal needs. This Projection Distance P also serves as a protection against bumping in crowds or chafing by an auto seat belt.

Figure 5A:
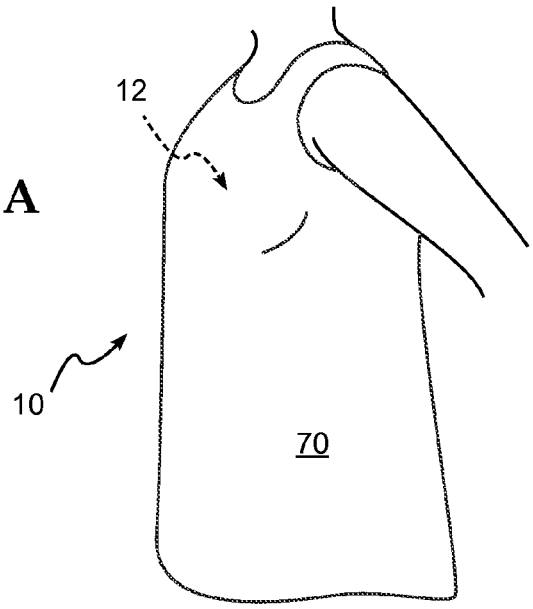
FIGS. 5A-5C are a series of line drawings of the combination of an inventive garment/prosthesis of FIGS. 4A-4C with a camisole or tank-top over-garment, showing how the prosthesis forms a shelf from which the camisole drapes in the front leaving the chest and stomach free from fabric contact.
Figure 5B:
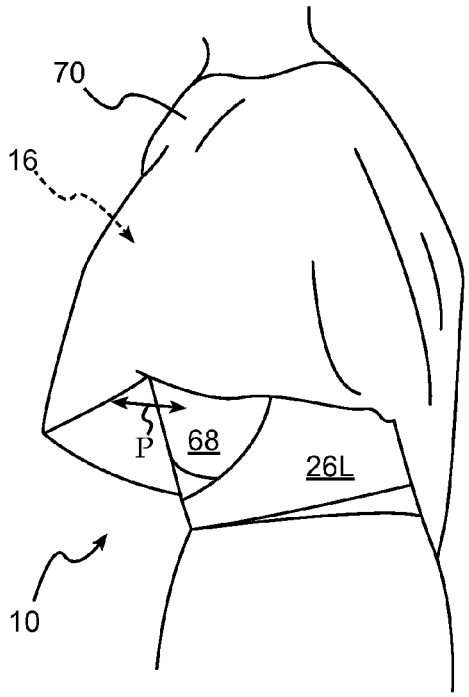
Figure 5C:
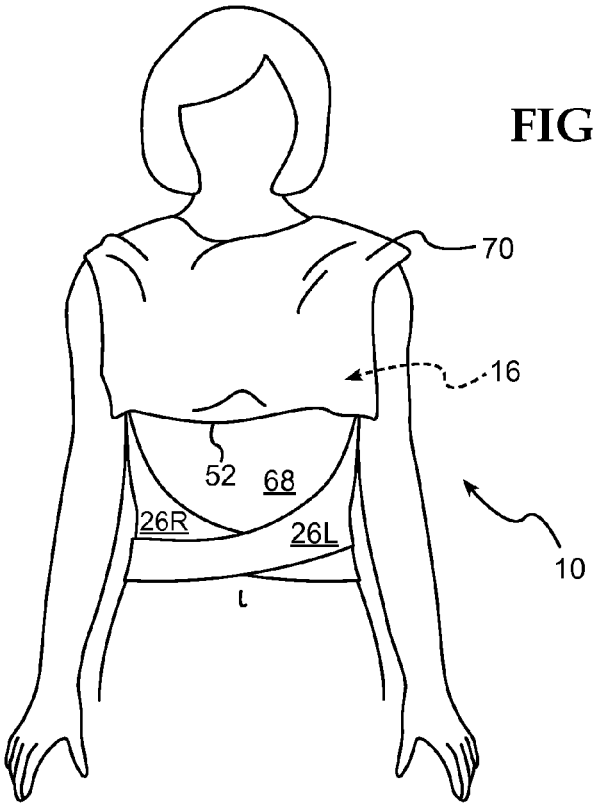

FIGS. 5A-5C are a series of line drawings of the combination of an inventive upper-half-bra garment 12 with a camisole or tank-top over-garment 70, showing how the prosthesis forms a shelf from which the camisole 70 drapes in the front leaving the chest and stomach free from fabric contact, the combination together being another embodiment of the inventive garment/prosthesis 10. FIG. 5A shows the camisole in the "as-worn", dressed, position, the appearance being natural, yet leaving the chest and stomach free of fabric contact and coverage. This latter point is best seen in FIGS. 5B and 5C, with the former being an isometric view from below, with the camisole 70 lifted up to the neck, to show the Projection Distance, P, and the fact that the inventive garment/prosthesis permits free skin area 68 of chest and stomach face. FIG. 5C is a front elevation further illustrating these points.

FIGS. 6A-6D are a series of line drawings of the combination of the inventive garment/prosthesis 16 with an over-garment, here a red dress 70 having a scoop neck-line, front and back, and showing how the chest and stomach remain free from fabric contact. FIG. 6A is a front left isometric view of the dress 70 as worn over the inventive upper half-bra garment 16, and FIG. 6B is a right rear isometric view which clearly shows the cantilever draping of the dress 70 down from the lower edge line 52 of the underlying upper-half bra garment. FIG. 6C is a front left isometric showing the dress 70 raised with the hemline at the neck, and showing the exposed chest and stomach area 58. FIG. 6D is a slightly right rear isometric in which the dress 70 is raised to reveal the tied bow 46 of the left and right ties 26R/26L, and the back panel 24.

Accordingly, the invention is characterized as a combination wearable garment and prosthesis for patients, predominantly female but optionally also male, who have had surgery or treatment for chest and abdominal trauma, broadly including, but not limited to, women (and men) having undergone chest and/or abdominal surgery, or treatment for ventral traumatic or epidermal conditions or injuries, which comprises in operative combination: a) a breast prosthesis including at least one of a left or a right female upper-half breast having an outwardly-sloping top surface terminating in a generally horizontal bottom marginal edge and a substantially vertical back surface portion; b) a wearable undergarment having means for removably retaining said at least one upper-half-breast prosthesis so that said breast prosthesis outwardly-sloping top surface is oriented upward; and c) said upper-half-breast prosthesis is configured in the shape of a female breast contoured in a natural "slope" form of the upper half of a breast, and being undercut to have no lower pendant breast portion, the horizontal bottom edge of said prosthesis forming the underside of a generally downwardly sloped cantilevered shelf, the lower outer marginal edge of said shelf generally follows a horizontal line approximately at the level of the nipples of a natural female breast; so that upon retainingly engaging said half-breast prosthesis to said undergarment and the patient putting on an over-garment, said over-garment will drape along said prosthesis upper half contour and over said shelf outer marginal edge, thereby providing a clearance space between said garment and exposed sensitive chest and ventral areas to prevent chafing and irritation.

INDUSTRIAL APPLICABILITY

It is clear that the inventive garment/prosthesis, alone as an upper-half-bra garment plus insertable/removable prosthesis, or together with an over-garment, will have wide applicability in the rehabilitation and post-operative recovery phases of medical service fields, particularly for women having undergone mastectomies, or men and women having undergone abdominal surgery, or treatment for ventral traumatic or epidermal conditions or injuries. For men, the usage may be private only, or the ventral extension minimized so as to not appear strange. Since both the under and over garments are susceptible to a wide range of creative designs, this inventive garment/prosthesis device will open new fashion design lines for female patients having a wide range of surgical procedures involving the thoracic cavity.

Various modifications within the scope of this invention can be made by one of ordinary skill in the art without departing from the spirit thereof and without undue experimentation. Accordingly, the invention is not to be limited to the exemplary implementations described herein.

The invention claimed is:

1. A combination garment and prosthesis for patients who have had surgery or treatment for chest and abdominal trauma, including patients having undergone chest and/or abdominal surgery, or treatment for ventral traumatic or epidermal conditions or injuries, comprising in operative combination:

a. a breast prosthesis including at least one of a left or a right female upper-half breast having an outwardly-sloping top surface terminating in a generally horizontal bottom marginal edge and a substantially vertical back surface portion;

b. a partial bra undergarment having means for removably retaining said at least one upper-half-breast prosthesis so that said breast prosthesis outwardly-sloping top surface is oriented upward; and c. said upper-half-breast prosthesis is configured in the shape of a female breast contoured in a natural "slope" form of the upper half of a breast, and being undercut to have no lower pendant breast portion, the horizontal bottom edge of said prosthesis forming the underside of a generally downwardly sloped cantilevered shelf, the lower outer marginal edge of said shelf generally follows a horizontal line approximately at the level of the nipples of a natural female breast;

d. so that upon retainingly engaging said half-breast prosthesis to said undergarment and the patient putting on an over-garment, said over-garment will drape along said prosthesis upper half contour and over said shelf outer marginal edge, thereby providing a clearance space between said garment and exposed sensitive chest and ventral areas to prevent chafing and irritation.

2. A combination garment and prosthesis for patients as in claim 1 wherein said retaining means is selected from a pocket integrated into said partial bra garment, snaps, hook and loop fastening members, and hook and eye assemblies.

3. A combination garment and prosthesis for patients as in claim 2 wherein said retaining means is a pocket integrated into said partial bra garment, said pocket being configured to retain-ingly receive said upper-half-bra prosthesis oriented with said prosthesis top surface oriented upwardly.

4. A combination garment and prosthesis for patients as in claim 3 wherein said partial bra garment is formed of at least an inner and an outer layer of fabric on a ventral portion of said bra, said inner and outer layers are stitched together along aligned and coordinate top and a bottom marginal edges to form said pocket, and said pocket includes at least one unstitched side margin forming an opening through which said prosthesis is inserted and removed.

5. A combination garment and prosthesis for patients as in claim 1 wherein said prosthesis is selected from a bilateral, double breast form, and a single breast, left or right, form.

6. A combination garment and prosthesis for patients as in claim 5 wherein said prosthesis is selected from a batting-filled fabric form, semi-rigid foam form, a high-density, visco-elastic memory foam-covered form, or plastic-encapsulated silicone gel form.

7. A combination garment and prosthesis for patients as in claim 4 wherein said partial bra garment includes a camisole-style scooped back portion that extends diagonally laterally into elongated tails that wrap fully around the waist of the patient, first from the patient's back side to the patient's front side where they diagonally overlappingly cross, and then on around to the back of the patient where they may be tied, so that the diagonal overlapping orientation of the side tails permits the entire chest wall and stomach to be exposed and free of any fabric contact with the skin, scar tissue, or other sensitive dermal areas by virtue of the front-to-back wrap of the securing elongated lateral side tails.

8. A combination garment and prosthesis for patients as in claim 7 wherein said partial bra garment includes over-the-shoulder straps or fabric web portions.

9. A combination garment and prosthesis for patients as in claim 1 wherein said prosthesis is flexible and configured with a breast top surface slope while not being rigid, and having a compliance to present a normal breast appearance while not so compressible to be unable to maintain a cantilever to produce a non-chafing clearance gap.

10. A combination garment and prosthesis for patients as in claim 7 wherein at least one of said tails includes a pocket having an upwardly facing opening.

11. A combination garment and prosthesis for patients as in claim 5 wherein said prosthesis is a bilateral upper-half-breast prosthesis.

12. A combination garment and prosthesis for patients as in claim 1 which includes an over-garment that drapes generally vertically over said lower marginal edge of said prosthesis to maintain said clearance space between said garment and patient's ventral surface.

* * * * *